United States Patent [19]

Ekstrom

[11] 4,192,111

[45] Mar. 11, 1980

[54] WINDOWS

[75] Inventor: Lars A. Ekstrom, Djursholm, Sweden

[73] Assignee: Raywall Kommanditbolag, Marsta, Sweden

[21] Appl. No.: 908,648

[22] Filed: May 23, 1978

[30] Foreign Application Priority Data

May 23, 1977 [SE] Sweden ..... 7705999

[51] Int. Cl.[2] ..... E06B 7/12

[52] U.S. Cl. ..... 52/171; 52/789

[58] Field of Search ..... 52/171, 172, 789, 404; 49/360, 361

[56] References Cited

U.S. PATENT DOCUMENTS

| | | | |
|---|---|---|---|
| 2,439,553 | 4/1948 | Winn | 52/171 X |
| 3,167,159 | 1/1965 | Bovenkerk | 52/171 X |
| 3,903,665 | 9/1975 | Harrison | 52/171 |
| 3,999,345 | 12/1976 | Mikelvey | 52/789 X |
| 4,093,352 | 6/1972 | Pisar | 52/171 X |

*Primary Examiner*—Carl D. Friedman

*Attorney, Agent, or Firm*—Finnegan, Henderson, Farabow, Garrett & Dunner

[57] ABSTRACT

Window including a rectangular frame, which supports and encloses at least two panes separated at a certain distance, a slab being placed between said two panes, said slab having a width corresponding to the width of the panes but having a height which is smaller than the height of the panes, said slab being displaceable up and down by a current of air which is introduced in the frame under the slab and is let out above the slab or vice versa.

5 Claims, 3 Drawing Figures

WINDOWS

This invention relates to a window for buildings, which window includes a rectangular frame and supports and encloses at least two plates or transparent panes separated at a certain distance. Between the plates from the inside of one plate to the inside of the other plate an heat isolation is inserted covering at least partly the area of said plates.

In order to save energy in houses, the known art teaches that the construction of the houses should be tight. The object of the invention is to make a tight window. Windows are used in buildings primarily in order to look through, secondly in order to let the day light in and thirdly to take in fresh air. In order to get said two first effects one has to be prepared to pay a high price; windows are expensive to produce and keep up and also a great part of the losses of heat depends on the windows.

One has tried to diminish the cost of keeping up windows by making the frames and the window-arches of resistant material and by hermetically sealing the windows, whereby one can keep the inner side of the windows from becoming dirty. One has also tried to diminish the loss of heat by increasing the amount of panes, whereby the amount of isolating layer of air is increased. Also, the panes have been covered with reflecting and low emitting material and shutters, venetian blinds and curtains have been used.

The object of this invention is thus to produce a window, which besides having the ordinary qualities, will require small cost to keep up and will allow small losses of heat.

The characterizing features of the invention are stated in the following claims and can be seen from the following description, which is made with reference to the accompanying drawing.

FIG. 1 hereby shows an elevation of a window seen from the inside of a building.

Figure 1:
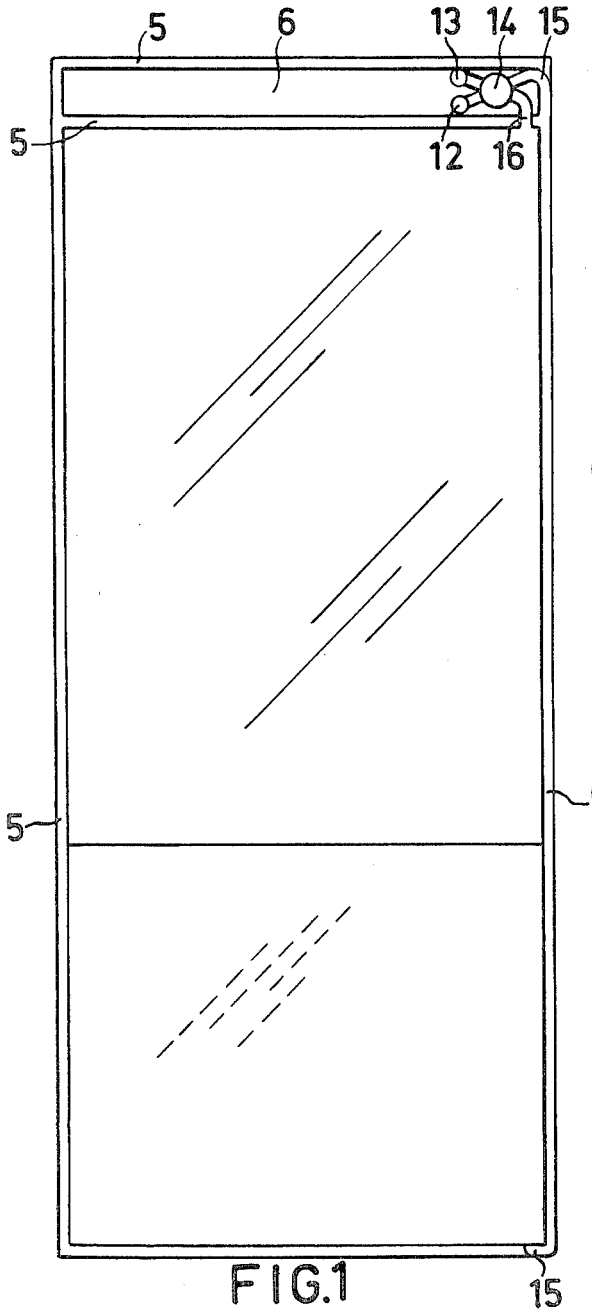
Figure 2:
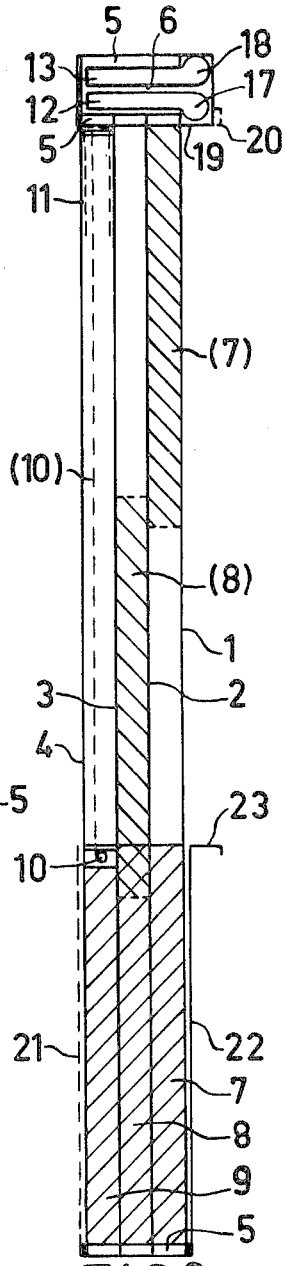
FIG. 2 shows a vertical section.
Figure 3:
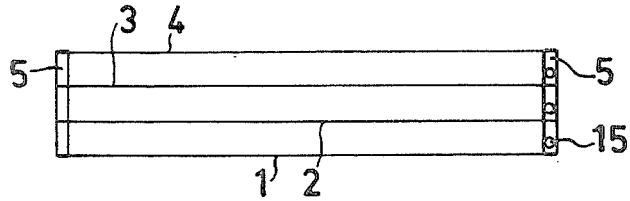
FIG. 3 shows a horizontal section.

The upper part of FIG. 1 shows a vertical section through the window in parallel with the panes. As shown in FIG. 2, four panes 1, 2, 3 and 4 are inserted with close fitting in a frame 5. The distance between the panes is greater than in ordinary windows. This frame can be considered as a window-arch but in order to distinguish the invention from the known art, the window-arch is named as a frame in the following. The frame is doubled in the top, so that a space 6 is formed, at which certain control means are placed. When mounting the window, heat insulating slabs 7, 8 and 9 are inserted one each in the space between the panes and the thickness of the slabs corresponds to the distance between two panes whereas the added height of the slabs is such, that when partly covering each other they will correspond to the height of the opening of the window. The thickness of each slab is adapted in relation to its softness and elasticity so that due to the friction between the slab and the surrounding panes the slab can stay in an optimum level in the window. In FIG. 2 numerals (7), (8) and (10) indicate three different levels in which the slabs 7, 8 and 9 may stay.

The heat insulating slabs may be of light mineral wool or glass wool and the lower and upper edges are covered with an air tight layer. The vertical sides of the slabs and the edges are covered with a material which does not scratch the panes when the slabs are moved in relation to the panes. This material may for instance be plush or any other textile material and when the slabs are moved this material will clean the surfaces of the panes. The arrangement of the heat insulating slabs and the space between the panes according to the invention may be compared with the known arrangement of a piston in a cylinder.

In the space 6, or beside the window, or in any suitable place within the building, a fan or an air pump is placed. Feeding pipes and return pipes connect the fan with the space between the panes so that a closed air system is created. FIGS. 1 and 2 show that one window can be connected to one fan which is intended for all the windows in a building. Note that the fan is not shown. Along the wall of the room just over the windows runs a feeding pipe 17 and a return pipe 18. Branches 12 and 13 respectively, connect the pipes 17 and 18 respectively, with three valves 14, one for each of the spaces between the panes of the window. In FIG. 1 one of the valves 14 is shown. The valves are so called 4-way valves and the valve is closed in its neutral position. In a first position the valve opens for air to pass from the feeding pipe 17 through a pipe 15 to the bottom of the window. In this position of the valve, the valve also opens so that, a pipe 16 will be connected to the return pipe 18. The pipe 16 connects the space between the panes at the top with the valve 14. Thus, in this position of the valve, said space above the slab and between the panes is vented through the return pipe 18.

When the valve is in a second position, the direction of the current of air is reversed so that air is passed into the upper part of the window, i.e. into the space between the two panes above the slabs, and the space in the bottom (under the slab) will be vented. The current of air, which will have a pressure of 1000 Pa or less, will push the heat insulating slabs upwards or downwards depending on whether the current of air is introduced in the top or in the bottom of the frame. The slabs will clean the surfaces of the panes when moving. Each valve may be controlled individually or automatically or centrally. The control may be carried out mechanically by a string or by an electromagnet or in any other way. The low pressure and a low amount of flow, say 50 $m^3/h$, permits very simple and cheap valves which may be of the type which includes a displacable plunge or includes a rotating cylinder.

An expanding vessel, not shown, can be connected to the suction side of the fan for balancing the pressure differences, which may arise depending on the variation of the height of the barometer and the temperature of the air within the windows and outside. There is a known type of a check valve, which automatically will allow fresh air to the expanding vessel if there has been a leak in the system. The fresh air can be filtered in an absolute filter and dried to low dampness in any known way. The circulating air within the system may also be filtered and dried continuously.

When the invention is used in large buildings such as schools and offices it may be advisable to connect a pressurized air vessel to the fan and the fan starts when the pressure within the vessel has sunk under a certain value. When the invention is used in small houses the fan can be so controlled, that it automatically starts when the valve is operated and the slabs will move.

When all the three heat insulating slabs are in their lowest position, they form a very well insulated breast work. Besides, the window has four panes having good heat insulation. Also the window will reduce noise from the outside because of the large distance between the panes.

When the heat insulating slabs together are cover the whole window opening, the heat insulation is increased. The window can be regarded as a window with three panes of glass, one of which is a highly heat insulating plate.

When the slabs are in closing position they will shut out the light and they will also keep away inconvenient sunshine. Because of the very good heat insulating properties of the slabs, the windows can be formed with very big openings which means that direct light and diffused light can be permitted when so desired and possible. More panes will increase the possibilities of making use of the heat of the sunlight when the temperature is low, for instance during winter.

As can be seen from FIG. 2, the outer slab 9 can stay in its lower position except when the panes shall be cleaned. Therefore, this plate may be fixed and means 10 may be arranged to carry out the cleaning operation. This means includes a spring loaded roll, on which a foil is rolled on, this foil being of the transparent type but reflecting the sunlight. It may be advisable to fix the outermost plate 9 and to form it with ducts for the pressurized air to pass so that the unrolling and rolling on of the foil may be controlled pneumatically in the same way as the slabs are moved. A piston, not shown, may be arranged to pull the foil and the piston has guiding pins 11 in order to prevent turning in the plane of the window. The foil will prevent to much of the sunlight from passing through the window when that is desirable and the foil will also increase the heat insulation of the window independently of the positions of the slabs. The piston should have a layer of a soft material, which will clean the panes and will give a certain friction so that the piston can be left hanging in a certain position.

Glass is a very good material for facades of buildings, but it may be advisable to arrange an outermost breast work 21 of metal, wood or any other suitable material. Also it may be advisable to arrange an innermost breast work 22 and a window board 23. Heating means for the room may be arranged on the innermost breast work. The feeding pipe 17 and the return pipe 18 may be covered by a cornice 19 having a curtain-rail 20.

An important advantage of the invention is that it is possible to avoid heating means under the windows—not completely but to a very large extent—which will reduce very much the costs for building the house. Moreover, there is a less need for energy to be supplied to heat up the building. This decrease in the need of supplied energy represents perhaps the greatest advantage of the invention. If the invention is used carefully, a positive k-constant will be obtained for a whole year.

The advantage of the invention is thus, that there is no need for cleaning the panes and the window has very good heat insulating properties and is closed so that no condensation will occur. The power required for heating the building will be so small, that it almost can be met by the power, which is needed for refrigerator, deep-freezer, oven, or other household machines within the building and by the heat emitted from individuals in the house. Means for heating water and other parts of the building do not form a part of the invention and will therefore not be described but it is obvious that an advantage of the invention is that house building will be less expensive.

Another advantage of the invention is that it will be possible to place beds under the window and control the slabs so that the light, which is necessary will fall in. No draft will appear in the neighborhood of the window.

There are several embodiments of the invention besides the one shown. Thus, there is shown four panes but it is possible to carry out the invention with three panes or more than four. Also the form of the slabs may be varied and also the material.

What I claim is:

1. A window comprising a frame, at least two transparent panes supported by and mounted within said frame in parallel relationship, said panes being separated from one another and defining a space between them, a slab of heat insulation material located in said space and having a width corresponding substantially to the width of the panes and a length less than the length of the panes, said slab being movable along the length of the panes, and control means located at each end of the length of the panes in said frame for supplying and receiving air to the space between the panes in a controlled manner whereby the slab can be selectively moved a distance along the length of panes by a current of air.

2. A window according to claim 1 including at least three panes mounted within the frame and defining a separate space between each pair of adjacent panes and at least two slabs one in each space and each having a width corresponding substantially to the width of the panes and a length when added together corresponding substantially to the length of the panes, said control means supplying and receiving a current of air to each of said spaces.

3. A window according to claim 1 or 2 in which the slabs have a thickness corresponding substantially to the distance between the panes and are made of elastic material and held in place by frictional resistance between the slabs and the inner surfaces of the panes but in which the current of air supplied to the space is sufficient to overcome the frictional resistance.

4. A window according to claim 3 in which the insulating slabs are made of mineral wool and have a thickness larger than the distance between the panes.

5. A window according to claim 1 or 2 in which the slabs are rectangular and the top and bottom edges are perpendicular to the direction of movement of the slab.

* * * * *